United States Patent [19]

Lacis et al.

[11] 4,236,129

[45] Nov. 25, 1980

[54] MERCURY CONTACT SWITCH

[75] Inventors: Laimons Lacis, Bloomfield; Steven Horvath, Irvington, both of N.J.

[73] Assignee: Gordos Corporation, Bloomfield, N.J.

[21] Appl. No.: 50,419

[22] Filed: Jun. 20, 1979

[51] Int. Cl.[3] ..... H01H 29/00

[52] U.S. Cl. ..... 335/55; 335/58

[58] Field of Search ..... 335/47, 48, 49, 50, 335/51, 55, 57, 58, 151, 154

[56] References Cited

U.S. PATENT DOCUMENTS

| | | | |
|---|---|---|---|
| 2,609,464 | 9/1952 | Brown et al. | 335/55 |
| 3,114,811 | 12/1963 | Kohman | 335/58 |
| 3,331,037 | 7/1967 | Hempel | 335/58 |
| 4,085,392 | 4/1978 | Lacis et al. | 335/58 |

*Primary Examiner*—George Harris

*Attorney, Agent, or Firm*—John C. Dorfman

[57] ABSTRACT

A mercury switch has two spaced apart electrical contacts mechanically supported by its glass envelope and electrically connected to external terminals. A third conductor passes through the glass envelope at the opposite end. A housing for mercury is formed by divergent plates supported on the third conductor, which housing extends into the mercury reservoir near its support so as to draw mercury into the space between the divergent plates. A magnetic partition is supported from the third conductor by a flexible hinge which allows the partition to move back and forth between the divergent plates of the housing alternately into each of a pair of stops between said two spaced apart electrical contacts. Whichever wall of the housing the partition is closest to, the space is narrowed so that the mercury rises under capillary attraction and contacts the electrical contact between the wall and the partition. As the mercury rises in this narrow area, it lowers in the space between the partition and the other wall as it widens causing contact to be broken between the mercury and the other one of the pair of electrical contacts. The situation is reversed as the partition moves to the other position. One position is preferably the stable or normal condition of the switch. The other position is the energized position in which magnetic field is applied to move the armature on the position and change switch condition.

10 Claims, 3 Drawing Figures

MERCURY CONTACT SWITCH

The present invention relates to a new type of switch employing mercury or other conductive liquids and is of the type which employs a magnetically actuated armature to achieve a change in switch position. More specifically, the present invention relates to a switch of this type in which armature movement is used to pump or squeeze mercury or other conductive liquid into contact with a fixed contact, thus completing a circuit through the mercury.

In the prior art, conductive liquid, and particularly mercury either in pure form to improve conduction, or with small traces of intentionally introduced impurities to minimize sticking, has been widely used between contacts in reed switches of the magnetically actuated types. By and large, the presence of mercury is not intended to completely replace the metal-to-metal contact of the reeds, but rather to insure that contact which might otherwise by imperfect is improved by the presence of mercury. The present invention, however, is not directed to such a device which uses a thin layer of mercury between solid contacts.

Mercury pools, as such, have been used in the prior art, as, for example, in connection with tilt switches. In such switches by properly orienting the position of the switch a pool of mercury is moved into a position where the mercury completes the circuit between the ends of spaced apart conductors. Reorienting the switch position to move the mercury pool away from the contacts then "opens" the switch and the circuit. Such switches are predominantly employed in situations where small mechanical force is used to switch relatively large electricl currents within sealed atmosphere, or horizontal reference position of mercury is essential.

In U.S. Pat. No. 2,312,672, C. E. Pollard, Jr. discloses a switch construction which may alternatively be used as a tilt switch or as a magnetically actuated switch. In the latter situation, mercury between parallel strips is forced toward the opened end of those strips when magnetic field is applied and draws the strips together. The strips are shaped to diverge slightly at their open end and in this region is placed a fixed contact which is contacted by the mercury which is forced outwardly by the squeezing together of the magnetic strips.

The present invention, like the Pollard structure uses part of the mercury pool itself as the contact, but it does not move the mercury into position by squeezing together a pair of flexible magnetic members. Instead, it moves mercury by means of capillary rise between alternate ones of a pair of divergent plates, forming a rigid housing, and a movable partition between the plates, preferably hinged at the convergent end of the housing. The partition has its movement limited by stops at its free end which extends beyond the divergent ends of a pair of plates. The convergent end is in communication with a reservoir from which it draws mercury by capillary attraction.

More specifically, in accordance with the present invention, a switch is provided which employs a rigid non-magnetic, non-conductive enclosure through which extend at least three electrical conductors. A pair of spaced apart electrical contacts are electrically connected to two of the at least three conductors which extend through the enclosure and are supported in fixed position relative to said enclosure. Part of the enclosure defines a reservoir for the conductive liquid (mercury)

as the result of the orientation of the switch. Conductive liquid within the enclosure is arranged to circulate into and out of said reservoir. A non-flexible holder for conductive liquid provides a confining space into which the liquid is drawn by capillary attraction. The conductive liquid provides an electrical path from the third of the at least three conductors, through the holder and conductive liquid to either of the electrical contacts with which the conductive liquid alternatively makes contact. The holder is of such shape and position relative to the reservoir to draw conductive liquid from the reservoir into the holder to a position proximate to each of the spaced apart electrical contacts. A partition, including a magnetic armature element, in the holder is so positioned as to be moveable in the presence of a magnetic field to a magnetic reluctance-minimizing position, which position also causes the conductive liquid in the holder to change the switch condition of at least one of the spaced apart contacts. As a practical matter, the partition is supported at its end remote from the contact and able to move back and forth toward the walls of the holder which are formed by diverging plates. The partition is limited in its movement by stops so that it never moves into either of the contacts but alternately approaches one or the other of the plates of the holder so that conductive liquid between that plate and the partition rises into contact with one of the electrical contacts as a result of capillary attraction between the close-spaced walls. The alternately rising columns of conductive liquid may be interconnected below the level of lowest height of each column.

It is also possible to omit one of the contacts so that instead of having one contact closed and one open each time, there is a single contact which is alternately closed or open in the two stable positions of the device. Theoretically, it is also possible to have a device in which there is a stable mid-position where neither switch contact of the two is actuated and to actuate the armature one direction or the other to close whichever switch is to be actuated.

For a better understanding of the present invention, reference is made to the accompanying drawings in which.

Figure 1:
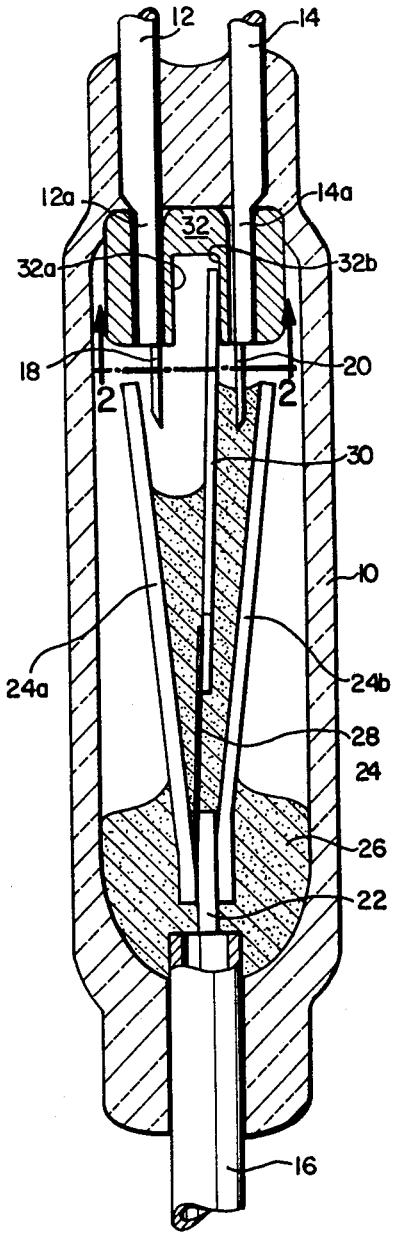
FIG. 1 is a longitudinal sectional view through the insulating envelope or enclosure of the switch of the present invention.

Referring now to FIG. 1, in particular, a rigid non-magnetic, non-conductive enclosure is provided, in this case, by glass envelope 10. Through envelope 10 are sealed three electrical conductors. Conductors 12 and 14 are sealed through one end, preferably in parallel spaced relationship. Conductor 16 is sealed through the opposite end and is, as illustrated, preferably a tubular member permitting introduction of mercury or other conductive liquid and hydrogen or other atmosphere as appropriate after the assembly is completed. The tubing may then be sealed off by means known in the art. Conductors 12 and 14 may typically be made of No. 42-6 alloy oxidized or of No. 52 alloy. Tubing 16 is preferably of No. 52 alloy. It typically is 0.050 inches in diameter having its end nickel-plated. The overall length of the envelope from one end to the other might be on the order of 0.750 to 0.800 inches, although it will be understood that other sizes may be employed in other situations.

Figure 2:
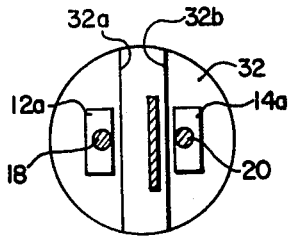
FIG. 2 is a sectional view taken along line 2—2 of FIG. 1 omitting sectioning of the mercury.

The conductors 12 and 14 within the envelope are preferably provided with magnetic extension 12*a* and the non-magnetic extension 14*a*, which may, for example, be composed of Hastelloy or other non-magnetic material. Both extensions are preferably formed in a rectangular cross-section as seen in FIG. 2. Sections 12*a* and 14*a*, in turn, are terminated in precious metal wire contact members 18 and 20, the ends of which are given a beveled edge in order to present a point to the mercury or other conductive liquid into which they will penetrate. The pair of spaced apart electrical contacts 18 and 20 may be composed, for example, of platinum-nickel alloy or pure nickel, the material selected being of a mercury-wettable type but not readily dissolved into the mercury. The contacts 18 and 20 are chisel pointed in opposite directions on conductors 12*a* and 14*a* for the purpose of minimizing the chance of mercury globules flying upwards to briefly complete a circuit during contact interruption.

The conductor 16, in turn, supports a mast 22 which provides the mechanical support for a holder 24*a*, 24*b* for conductive liquid which is fixed in position and inflexible and provides a confined space for conductive liquid and an electrical path from the conductor 16 through mast 22 to the conductive liquid in the holder. The holder is of such shape and position relative to the reservoir 26 formed by the inside wall of the glass enclosure that it may draw the conductive liquid mercury from the reservoir into the holder into a position proximate to each of the spaced apart electrical contacts 18 and 20. In practice, the holder, in its preferred form, is provided by a pair of flat nickel-plated mercury-wettable Hastelloy strips 24*a* and 24*b* or strips of pure nickel diverging from their points of attachment to mast 22 to points bracketing, or outside of, the contacts 18 and 20.

Figure 3:
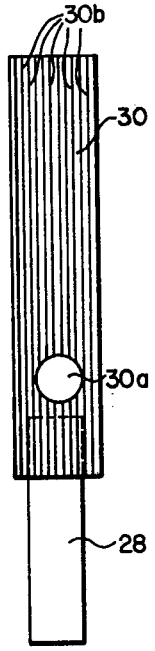
FIG. 3 is a plan view showing the armature partition removed from the structure of FIG. 1 and viewed at 90° to the view in FIG. 1.

Within the holder and also supported on the mast 22, preferably by a flexible hinge 28 as seen in FIGS. 1 and 3, is a partition 30. Preferably the partition itself is made of a magnetic material such as No. 78 permalloy in the form of a grooved strip nickel-plated and mercury-wettable. In other embodiments, however, a magnetic armature element may be a small piece of the partition or the partition may be composed of non-magnetic as well as the magnetic portions. If the flexible member 28 is not sufficiently narrow, the partition 30 can be provided with hole 30*a* to permit the flow of mercury from one side of the partition to the other. It is provided with parallel grooves 30*b* of a size to act as capillary grooves tending to draw the mercury upward along the partition above the housing. Although these grooves 30*b* have been shown to be straight and parallel, they may be in a variety of geometrical patterns and grooves may be interconnected so that mercury is drawn from one groove to another.

The partition 30 cooperates with a ceramic insulator spacer piece 32 which may serve to add rigidity to the conductors 12*a* and 14*a* and better support contacts 18 and 20. However, the insulator 32 also provides a groove or channel across its diameter as seen in FIGS. 1 and 2 into which extends the end of partition 30 as it is mounted in the envelope. In this preferred construction the groove provides stops in the sidewalls 32*a* and 32*b* of the channel which limit the overall movement of partition to a very limited distance and provide a referencing or indexing position for the partition at either of two extreme locations. This enables a bias to be supplied to the spring support 28 urging the partition into stop 32*b*, for example. This bias, when overcome by magnetic flux, will draw the partition 30 over against the stop 32*a* in a sort of snap action. When the flux is removed, the partition will return to its original position against wall 32*b*.

The insulator spacer 32, in addition to increasing structural stability, eliminates flat glass surface between the conductors and thereby also provides protection against short circuiting of conductors 12*a* and 14*a* by accumulation of mercury between them. Small mercury globules produced by contact interruption "fly" upwards and might accumulate on the glass. The insulator material may be selected to "shed" mercury and, in any event, its groove provides a much longer path to fill. The use of such insulator has not been possible in the prior art because of overlapping metal-to-metal contact members in the region occupied by the insulators. W. D. O'Brien and C. E. Pollard in their U.S. Pat. No. 3,054,873 provide a switch construction of different geometric form to solve the same problem.

As shown, the envelope is provided with a supply of conductive liquid, preferably pure mercury or mercury with small amounts of dopant, as understood in the art. It is also provided with an atmosphere of inert or oxide reducing gas, preferably hydrogen at a pressure of something on the order of 150 pounds per square inch with a helium tracer included. The switch necessarily must be oriented in a vertical position so that the mercury pool rests in the reservoir 26 provided for it and is drawn by capillary attraction into the holder 24, and specifically into the separate compartments thereof defined by the partition 30 and the respective walls 24*a* and 24*b*.

As seen in FIG. 1, the narrowing of the compartment formed by partition 30 and holder wall 24*b* causes the mercury column to rise into contact with contact 20, thus closing the switch provided thereby and completing any circuit into which conductors 14 and 16 are connected. At the same time, contact 18 is not touching the mercury or any metallic portion of the structure, and, hence, any circuit connected between conductors 12 and 16 remains open. When a magnetic field is applied to the left side of FIG. 1 to draw the armature/partition 30 into stop 32*a*, a compartment between holder wall 24*b* and partition 30 is enlarged and the level of mercury drops below the contact 20, thus opening that circuit. At the same time, the spacing between partition 30 and wall 24*a* decreases, causing the level of the mercury in that compartment to rise into contact with contact 18, thus completing any circuit connected between conductors 12 and 16. When the magnetic force is released, the spring 28, biased as it is to return the partition of FIG. 1, will open the switch involving contact 18 and close the switch involving contact 20.

Various modifications to the structure shown in these drawings is contemplated. For example, it is considered practical to employ a variation of this switch in which the partition 30, or its equivalent, is supported at a midpoint, or neutral position, in which neither switch contact 18 or 20 is closed, and then, using separate magnetic fields to draw the partition to the right or to the left, select the switch to be closed.

It is also possible to vary substantially the particular form shown for the structure including the form of the holder for the conductive liquid and the shape, form and type of support for the partition. All such modifications and others contemplated by the scope of the appended claims are intended to be within the scope and spirit of the present invention.

We claim:

1. A switch comprising:

a rigid non-magnetic, non-conductive enclosure, through which extend at least three electrical conductors;

a pair of spaced apart electrical contacts electrically connected to two of the at least three conductors which extend through the enclosure and supported in fixed position relative to said enclosure, a reservoir defined by part of said enclosure;

a conductive liquid within said enclosure arranged to circulate into and out of said reservoir, a non-flexible holder for conductive liquid providing a confined space and an electrical path from the third of the at least three conductors through conductive liquid in the holder to either of the electrical contacts with which conductive liquid alternatively makes contact, the holder being of such shape and position relative to the reservoir to draw conductive liquid from the reservoir into the holder to a position proximate to each of the spaced apart electrical contacts, and a partition including a magnetic armature element in the holder so positioned as to be movable in the presence of a magnetic field to a magnetic reluctance minimizing position which position also acts upon the conductive liquid in the holder so as to change switch condition of at least one of the spaced apart contacts.

2. The switch of claim 1 in which the partition is supported at the end remote from the contacts by a flexible connection member in turn supported on and electrically connected to said third conductor.

3. The switch of claim 2 in which the partition is limited in its movement by stop means defining to extreme positions of the partition, each closer to a different one of the pair of spaced-apart electrical contacts but not in contact with it, insulation means being provided between the partition and the contacts.

4. The switch of claim 3 in which the stops for the partition are provided by sidewalls of a channel provided in an insulating member providing support for and defining the positioning of the pair of spaced-apart electrical contacts.

5. The switch of claim 2 in which the holder is defined by divergent planar elements supported from the third conductor and essentially rigidly fixed in position such that the direction of extension of their unsupported ends if projected extends beyond the outside of the pair of spaced apart electrical contacts and the partition is provided with stop means which limit its movement inside but out of contact with the electrical contacts whereby as the partition is moved closer to one of the stationary walls forming the housing, capillary attraction of the conductive liquid between the partition and that wall is increased and draws the liquid higher and into contact with the electrical contact between the partition and that wall.

6. The switch of claim 5 in which conductive liquid is, at least in substantial part, mercury.

7. The switch of claim 6 in which the enclosure is filled with an inert gas.

8. The switch of claim 6 in which the enclosure is filled with an oxide reducing gas.

9. A switch comprising;

a rigid non-magnetic, non-conductive enclosure, through which extend at least two electrical conductors, a reservoir defined by part of said enclosure, a conductive liquid within said enclosure arranged to circulate into and out of said reservoir.

a holder for conductive liquids defined by a pair of plates supported on the structure adjacent to one of the conductors and diverging outwardly away from that position providing a confined space and an electrical path from the conductor through the holder and the conductive liquid which holder is in contact with the conductive liquid in the reservoir to draw conductive liquid from the reservoir into the holder, an electrical contact electrically connected to the other of the conductors and located between the divergent ends of the holder plates but positioned proximate to one of the plates and remote from the other, a partition including a magnetic armature element positioned between the plates of the holder and flexibly hinged to the conductor structure supporting the plates of the holder, and stop means positioned adjacent the outer end of the partition remote from its end of attachment intermediate the plates of the holder and on the opposite side of the electrical contact from the plate to which said contact is proximate, said partition having a stable position against one of said stops and being drawn into the other stop by application of a magnetic field whereby the movement of the partition changes the level of the conductive fluid between the holder wall and the partition so that in one position it contacts the electrical contact and in the other position it is out of contact with the electrical contact.

10. The structure of claim 8 in which the normal condition of the switch is open and the imposition of a magnetic field draws the partition toward the electrical contact and causes the conductive liquid to move into contact with the contact, closing the switch.

* * * * *